United States Patent [19]

Bolldorf

[11] 4,276,838

[45] Jul. 7, 1981

[54] THREAD CHANGER FOR EMBROIDERING MACHINES

[75] Inventor: Kurt Bolldorf, Kaiserslautern, Fed. Rep. of Germany

[73] Assignee: Pfaff Industriemaschinen GmbH, Fed. Rep. of Germany

[21] Appl. No.: 165,799

[22] Filed: Jul. 3, 1980

[30] Foreign Application Priority Data

Jul. 5, 1979 [DE] Fed. Rep. of Germany ..... 2927142

[51] Int. Cl.[3] ..... D05B 55/16; D05C 11/06

[52] U.S. Cl. ..... 112/221

[58] Field of Search ..... 112/221, 220, 270, 79 R, 112/84, 83, 98

[56] References Cited

U.S. PATENT DOCUMENTS

| | | | |
|---|---|---|---|
| 2,832,301 | 4/1958 | Wear | 112/221 X |
| 2,989,014 | 6/1961 | Redmon | 112/221 X |
| 3,075,481 | 1/1963 | Stratton | 112/221 |
| 3,502,044 | 3/1970 | Brown et al. | 112/221 X |

*Primary Examiner*—H. Hampton Hunter

*Attorney, Agent, or Firm*—McGlew and Tuttle

[57] ABSTRACT

In a machine for embroidering a workpiece of the type having a needle magazine, a plurality of needles movably mounted to the needle magazine to define a needle groove, each needle of the needle group equipped with a different thread, and a mechanism for selectively imparting axial reciprocatory movement to the needles of the needle group to perform a thread change, an improved arrangement is disclosed in which the reciprocating mechanism includes a single elongated needle bar associated with the group. The needle magazine is movable relative to the needle bar to selectively align each needle with the needle bar. A disengaging coupling permits a selected needle of the needle group to be coupled to the needle bar. A locking mechanism is provided for detachably locking each of the needles to the needle magazine.

13 Claims, 7 Drawing Figures

4
11
18
17
1
31
29
49
38
28
14
44
36
37
48
50
47
10
27
22
13
21
12
2

4
11
1
8
17
18
31
29
25
26
VII
VII
44
28
34
14
50
47
10
27
20
19
13
12
2

THREAD CHANGER FOR EMBROIDERING MACHINES

FIELD AND BACKGROUND OF THE INVENTION

The invention, in general, relates to an embroidering machine and, more particularly, to a new and useful small embroidering machine in which several needles equipped with different threads are combined to needle groups to perform a change of threads, where one needle of a needle group can be brought into operating position.

In an arrangement disclosed in West German Pat. No. 2,027,630, a plurality of needle bars are provided on a needle carrier. The needle bars can be axially brought into an active or inactive position relative to the needle carrier. If the needles of such an arrangement are equipped with different threads, changing to another thread is made possible by stopping certain needles and activating other needles. Arrangements of this type require a shuttle for each needle and, therefore, such structures are very costly. Moreover, since the workpiece must be placed under the newly selected needle with each change of threads or needles, expenditures for controlling the movement of the workpiece are particularly high.

In order to permit a change of threads without displacement of the workpiece, a plurality of differently threaded needles are combined, in other known arrangements, into a group, and designed as a closed part which is displaceable and adjustable relative to the needle bar drive, and only a certain needle bar of a needle group is used for embroidering corresponding to the adjusted position. The closed part can be designed as a carouseltype rotatable or displaceable carrier thereby permitting movement of the individual needle bars to the stitchforming area.

The known models, particularly the models with a plurality of needle bars combined to a frame-type carrier or a carousel, have the disadvantageously large parts and a particularly high space intensity. In addition, the need for complicated coupling means is quite costly, and particularly in small embroidering machines, the use of thread changers is made difficult.

SUMMARY OF THE INVENTION

The invention addresses the problem of providing a device for selecting the threads to be embroidered, which avoids, on the one hand, the movement of the material to be embroidered for a thread change, and which is on the other hand, simple and particularly space-saving in its constructional design.

This problem is solved, according to the invention, by means of needles combined to groups associated with a single needle bar for each needle group. A needle holder for each needle in a magazine which moves transversely to the direction of motion of the needle bar. Each needle holder, in accordance with the inventive arrangement, can be connected by means of a disengaging coupling with the needle bar and is received in the magazine by means of a holding assembly that can be disengaged and locked in dependence on the actuation of the coupling. In the inventive arrangement, it is possible to couple a needle or its needle holder belonging to a needle group with the needle bar, while all other needles or needle holders of this group are locked in the magazine and do not move. The needle bar thus engages the needle bar brought into its path of motion from the magazine and performs with it, after coupling, the embroidering movements, while all other needle holders remain locked in the magazine. The desired position of the selected needle holder relative to the needle bar is made possible by the adjustable position of the magazine relative to the needle bar.

A particularly simple operation for the coupling and the holding assembly results from the fact that the coupling and the holding assembly are so correlated with each other that both can be actuated successively by a single switching stroke of the needle bar. It is a particular advantage of the invention that the switching stroke of the needle bar may be provided in a region above its working stroke proper.

In order to lock the holding assembly before a needle holder is disengaged and then to effect the disengagement, while in the engagement of the coupling the coupling operation is performed first and then the holding assembly is disengaged, a pivotally mounted two-arm retaining clip is provided on the needle holder, whose substantially horizontal first arm effects the coupling between the needle holder and the needle bar, and whose substantially vertical second arm has a catch controlling the locking of needle holder and magazine. Because of this double function of the retaining clip, the latter is an important element for the compact and space-saving design of the entire inventive arrangement. This dual function ensures that the needle bar entering the needle holder in the embroidering direction of motion is automatically coupled, and that the needle holder is locked in the magazine during the somewhat longer return stroke, compared to the working stroke of the needle bar, and then disengaged from the needle bar.

Thus, according to the invention, in a machine for embroidering a workpiece of the type having a needle magazine, a plurality of needles movably mounted to the needle magazine to define a needle group, each needle of the needle group equipped with a different thread, and means for selectively imparting axial reciprocatory movement to needles of the needle group to perform a thread change, the improvement wherein the reciprocating means comprises a single elongated needle bar associated with the group and further comprising means for moving the magazine relative to the needle bar to selectively align each needle with said needle bar, means for disenagagably coupling a selected needle of the needle group to the needle bar, and means for detachably locking each of the needles to the needle magazine is provided.

In accordance with the preferred embodiment of the invention, each of the needles includes a needle holder connected thereto. The coupling means includes a retaining clip having first arm means for coupling the needle holder of a selected needle to the needle bar and second arm means angularly attached to the first arm means for engaging the locking means to control the locking of the needle holder of a selected needle to the needle magazine. The needle holder preferably includes a tubular extension having a socket proportioned for axially receiving the needle bar and a wall portion including an opening. The first arm means of the retaining clip is operable to engage the needle bar through the opening, when the needle bar is inserted in the socket, to couple the needle bar to the needle holder.

In accordance with the invention, an improved machine for embroidering the workpiece is provided which is simple in design, rugged in construction and economical to manufacture.

For an understanding of the principles of the invention, reference is made to the following description of a typical embodiment thereof as illustrated in the accompanying drawings.

DETAILED DESCRIPTION

Figure 1:
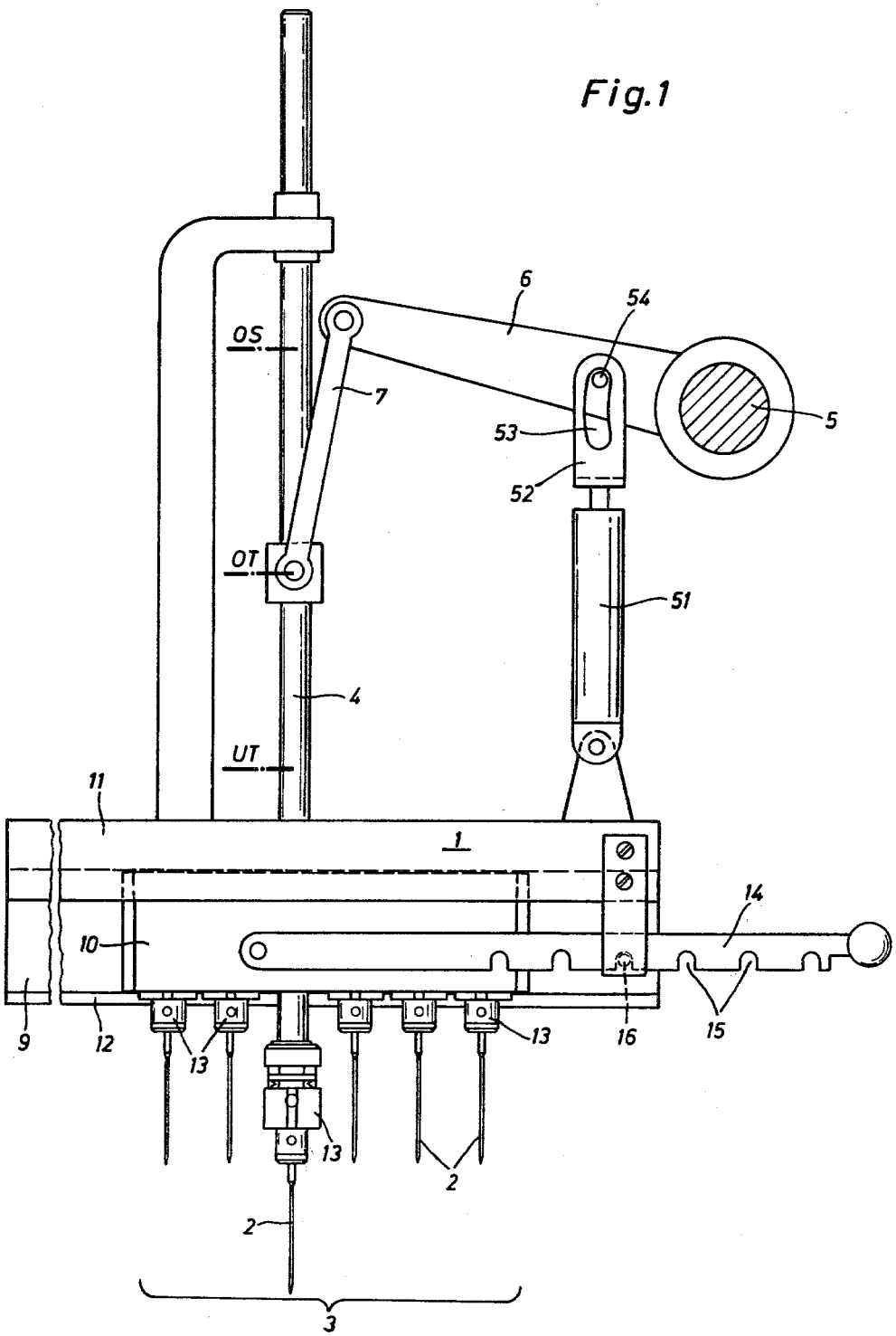
FIG. 1 illustrates a front elevation view, partly in section, of the head of an embroidering machine with the thread changer.

FIG. 1 shows the head 1 of an embroidering machine, which is equipped with a plurality of needles to be provided with different threads. Several needles 2 are combined to a so-called needle group 3 and assigned to a certain stitch forming area of the embroidering machine.

Figure 6:
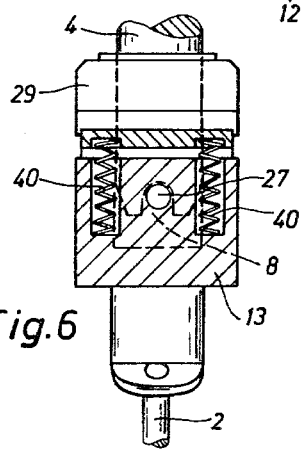
FIG. 6 illustrates a section taken along line VI—VI of FIG. 2.
Figure 7:
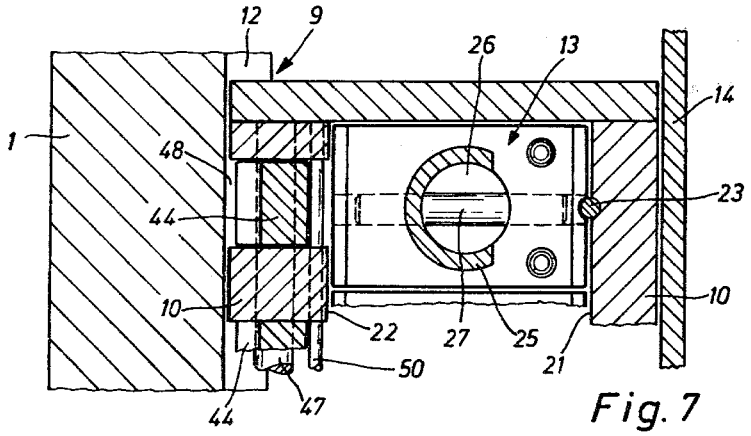
FIG. 7 illustrates a section taken along line VII—VII of FIG. 4.

A single needle bar 4 is provided for each needle group 3 guided in head 1 of the machine. The drive of needle bar 4 is effected by a switch shaft 5 which is connected with needle bar 4 through a rocker arm 6 and a connected guide rod 7. At the bottom end face of the needle bar 4, a recess 8 (FIG. 6) is provided which extends in transverse direction relative to the longitudinal axis of needle bar 4. The recess 8 is substantially U-shaped.

A support guide 9 for a magazine 10 is provided on head 1 of the machine. The magazine 10 transversely extends relative to the longitudinal needle bar axis and is transversely movable inside support guide 9 by two strips 11, 12 which, at the same time, form the guide 9.

A plurality of needle holders 13 which are arranged in magazine 10 carry the needles 2. The needles 2 are equipped with various threads. For laterally displacing magazine 10 and for securing its relative position to head 1, a lever 14 is pivotally mounted on head 1. The lever 14 has a number of laterally spaced recesses 15, corresponding to the number of needle holders 13, which can be engaged by a pin 16 carried in head 1. Magazine 10 is designed as a profiled piece with a cross U-section whose open side faces needle 2. In its crossbar 17 are provided bores to permit the passage of needle bar 4, corresponding in number and spacing to the number and spacing of needle holder 13.

Needle holders 13 are rectangular in cross-section and include lateral outer surfaces 19, 20 which are guided on inner walls 21, 22 of magazine 10. In order to secure the lateral spacing of each of the needle holders 13, guide projections 23 are provided on inner wall 21 formed, in the illustrated embodiment, by pins cooperating with slot-type recesses 24 provided in needle holders 13. On each needle holder 13, an extension 25 is formed. The extension 25 is formed with socket or an opening 26 having a cross-section that corresponds to the cross-section of the needle bar 4 for receiving the lower end of needle bar 4 which protrudes through a bore 18 of magazine 10. Inside opening 26, a stop 27, extending transversely to the longitudinal axis of needle bar 4, in cooperation with recess 8 provided in the lower end face of needle bar 4, secures the relative position between needel bar 4 and needle holder 13. This arrangement determines the correlation of needle bar 4 and needle holder 13 both in terms of height and angle.

As best shown in FIGS. 2, 5, 6, and 7, a cutting ring bearing 29 is secured to extension 25 by means of a pin 28 which engages a recess in extension 25. A bearing cutting edge 30 is formed on cutting ring bearing 29. Underneath cutting ring bearing 29, a two-arm retaining clip 31 is arranged which has a substantially horizontal first arm 32 and a substantially vertical second arm 33. Horizontal arm 32 of retaining clip 31 is provided with an aperture 34 which embraces extension 25 of needle holder 13. Needle holder 13 is provided with an opening 35 so that boundary surface 36 of aperture 34, which corresponds to the surface of needle bar 4, can engage the needle bar 4 conducted into opening 26. A free end 37 of arm 32 projects relative to cutting ring bearing 29 and cooperates with a stop surface 38 (see FIG. 3) on magazine 10 to disengage needle bar 4 from needle holder 13. Bores 39 are provided in needle holder 13. Compression springs 40, inserted in the bores 39, engage the underside of arm 32 of retaining clip 31 and tend to impart to the latter a counterclockwise swivel movement about bearing edge 30.

Vertical arm 33 of retaining clip 31 has a catch 41 on which both an upper and a lower bevel 42, 43 are formed. To each catch 41 of retaining clip 31, and thus to each needle holder 13, a holding jack 44 is assigned which is likewise provided with an upper and lower bevel 45, 46. A plurality of holding jacks 44 are pivotally mounted, on a common shaft 47 secured to magazine 10, inside corresponding recesses 48 in the magazine. The holding jacks 44 can be pivoted independent of each other and are each urged by a compression or jack spring 49 into engagement with a common stop 50 for all holding jacks 44 which is likewise carried by magazine 10.

The embroidering head carries a double-acting compressed-air cylinder 51. The cylinder 51 includes a forkhead 52 provided with an arcuated oblong hole 53. A pin 54, carried by rocker arm 6, protrudes into oblong hole 53. The length of oblong hole 53 corresponds to the dimension of the working stroke of needle bar 2, so that pin 54 carried by rocker arm 6 can freely move within oblong hole 53 during the movement of needle bar 4 between points UT and OT.

Figure 2:
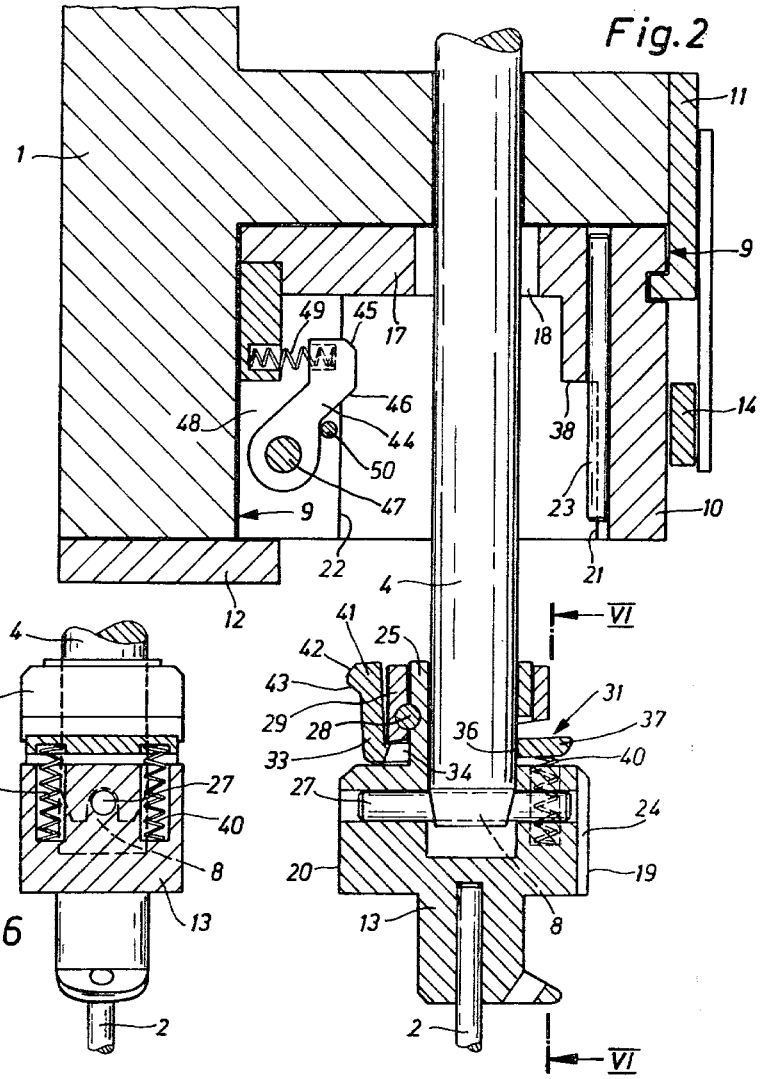
FIG. 2 illustrates an enlarged vertical cross-sectional view of a thread changer with the needle bar in operating position.
Figure 3:
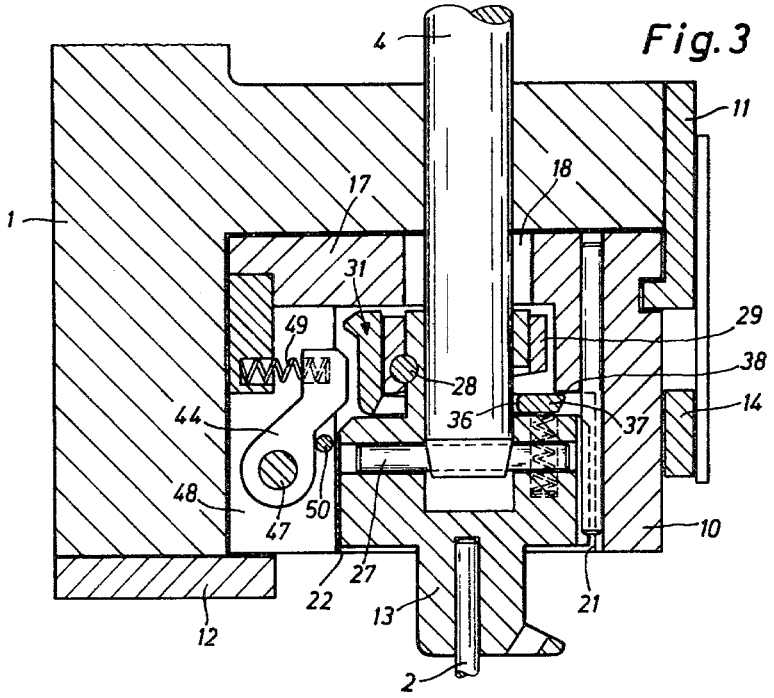
FIG. 3 illustrates a thread changer, according to FIG. 2, with the needle bar during disengagement.

The operation of the device may now be described in detail. Assume that magazine 10 is positioned corresponding to a point in which the desired thread is to be embroidered onto a workpiece and is secured in position by lever 14. Needle bar 4 protrudes through one of the bores 18 of magazine 10 and is coupled at its bottom end with one of needle holders 13 (FIG. 2). Stop 27 provided in needle holder 13 is positioned inside the recess 8 of needle bar 4, so that the relative position between needle bar and needle holder is fixed. Arm 32 of retaining clip 31, loaded by compression springs 40, bears with boundary surface 36 of recess 34 onto needle bar 4 and thus holds the latter in frictional connection with needle holder 13. The needle holder 13 is thereby connected to needle bar 4 and moves needle bar 4. The remaining needle holders 13 are held in a locked positioned in magazine 10. For changing the thread, needle bar 4 is stopped in its upper dead center position OT. Compressed-air cylinder 51 is operated so that its forkhead 52 extends in an upward movement. The movement of forkhead 52 has no effect on rocker arm 6 until pin 54 carried by its bears on the bottom surface boundary of oblong hole 53 provided in forkhead 52. In the further course of the upward movement of forkhead 52 receives a switching stroke adjoining its upper dead center position and extending from OT to OS. Needle holder 13 is thus retracted into magazine 10, and its lateral surfaces 19, 20 are conducted to inner walls 21, 22 of magazine 10. At the same time, recess 24 moves into the vicinity of guide 23 so that the relative position of needle bar 13 to be disengaged is secured in magazine 10.

During this upward movement of the needle bar, upper bevel 42 of catch 41 of retaining clip 31 engages and bears on lower bevel 46 of holding jack 44 associated with needle bar 13 to be disengaged, and imparts to holding jack 44 a swivel movement about its shaft 47 opposite to the biasing force of spring 49. As soon as catch 41 is above holding jack (FIG. 3) the free end 37 of horizontal arm 32 bears on stop surface 38 of magazine 10. When needle bar 4 continues its upward movement, retaining clip 31 performs a clockwise swivel movement, so that boundary edge 37 of recess 34 moves away from needle bar 4 and the needle bar 4 is thus released from the needle holder 13.

Figure 4:
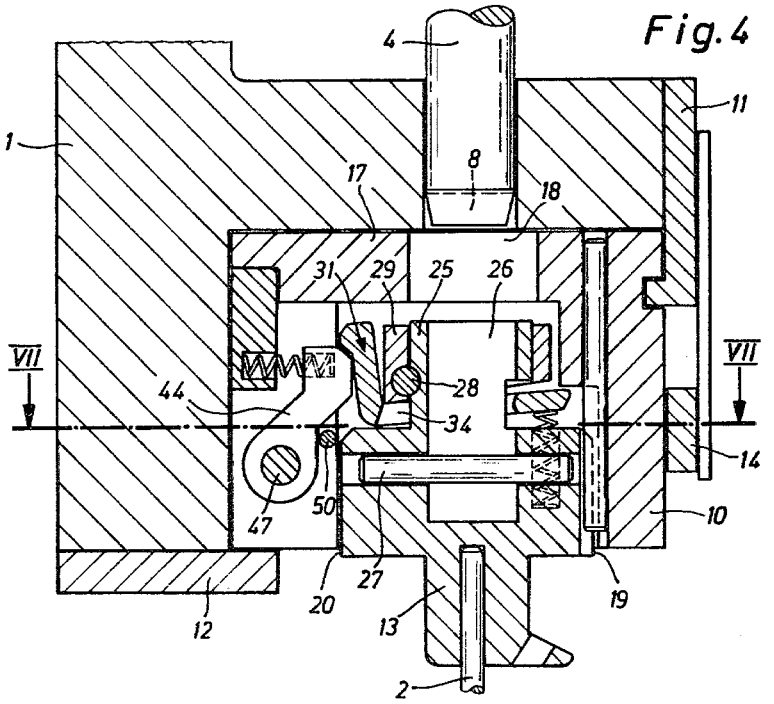
FIG. 4 illustrates the thread changer, according to FIG. 2, with the needle bar in the disengaged position.
Figure 5:
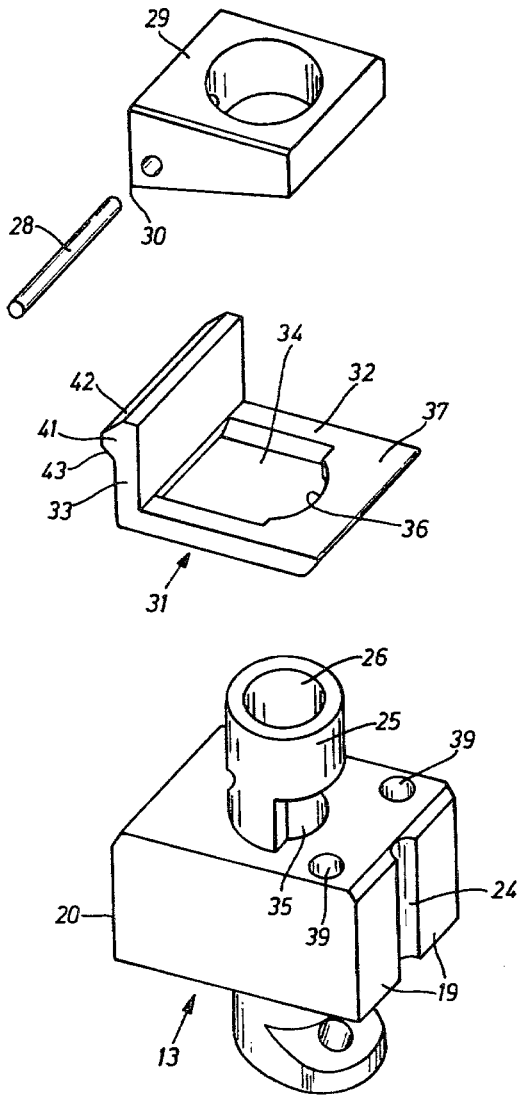
FIG. 5 is an exploded perspective view of the needle holder with the retaining clip.

As soon as the frictional connection between arm 32 of retaining clip 31 and needle bar 11 is released, needle holder 13 to be disengaged is completely free. The holding jack, returned by the action of spring 49 to stop 50, is below catch 41 of retaining clip 31, so that needle holder 13 only drops down by gravity until bevel 43 of catch 41 bears on bevel 45 of holding jack 44 (FIG. 4). The disengaged needle holder 13 is now held in the same manner as the other needle holders in magazine 10.

After lever 14 has been unlocked, magazine 10 is moved so far inside guide 9 until opening 26 of needle holder 13 carrying the desired thread is aligned with needle bar 4. After magazine 10 has been locked in its new position, compressed-air cylinder 51 is admitted in opposite direction. Needle bar 4 performs now a switching stroke leading from position OS to position OT and is guided with its bottom end into opening 26 of the selected needle holder 13. Since boundary surface 36 of recess 34 is within the path of motion of needle bar 4, retaining clip 31 performs a swivel movement. Since this swivel movement is against the force of springs 40, there is again a frictional connection between needle bar 4 and retaining clip 31. After overcoming this frictional connection, needle bar 4 is introduced so far into needle holder 13 until stp 27 is inside recess 8 of the needle bar. Needle bar 4 is now coupled with the newly selected needle holder 13.

During the further downward movement of the needle bar, the bottom level 43 of catch 41 bearing on bevel 45 of catch 41 associated with the selected needle holder 13 pushes holding jack 44 back, so that needle bar 4 can be guided with coupled needle holder 13 up to the upper dead center OT of its working stroke (FIG. 2). In this position of the needle bar, compressed air-cylinder 51 is evacuated, and the drive of swing shaft 5 is turned on. Needle bar 4 performs now with the newly selected needle holder its working stroke between points OT and UT.

In the represented embodiment, the movement of magazine 10 serving to select the thread or needle holder is effected by hand. This manual operation can naturally be replaced by a mechanical control device, for example, by a geared motor cooperating with a toothed bar, whose drive is integrated into the control of the embroidering machine. It is not, moreover, absolutely necessary to impart a rectilinear movement to magazine 10. Support guide 9 can naturally also be curved, so that magazine 10 performs a circular movement about the needle bar.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

What is claimed is:

1. In a machine for embroidering a workpiece of the type having a needle magazine, a plurality of needles movably mounted to the needle magazine to define a needle group, each needle of the needle group equipped with a different thread, and means for selectively imparting axial reciprocatory movement to needles of the needle group to perform a thread change, the improvement wherein the reciprocating means comprises a single elongated needle bar associated with the group, and further comprising means for moving the needle magazine relative to said needle bar to selectively align each needle with said needle bar, means for disengageably coupling a selected needle of the needle group to said needle bar, and means for detachably locking each of the needles to the needle magazine.

2. The improvement according to claim 1, wherein said needle bar is axially operable in a single switching stroke to successively actuate coupling means and said locking means.

3. The improvement according to claim 1, wherein each of said needles includes a needle holder connected thereto, and wherein said coupling means includes a retaining clip having first arm means for coupling said needle holder of a selected needle to said needle bar, and second arm means angularly attached to said first arm means for engaging said locking means to control the locking of said needle holder of a selected needle to said needle magazine.

4. The improvement according to claim 3, wherein said needle holder includes a tubular extension having a socket proportioned for axially receiving said needle bar, said tubular extension having a wall portion including an opening, and wherein said first arm means of said retaining clip being operable to engage said needle bar through said opening, when said needle bar is inserted in said socket, to couple said needle holder to said needle bar.

5. The improvement according to claim 4, wherein said coupling means includes a spring connected to said needle holder and said retaining clip for resiliently biasing said retaining clip into a coupling portion.

6. The improvement according to claim 3, wherein said coupling means includes a spring connected to said needle holder and said retaining clip for resiliently biasing said retaining clip into a coupling portion.

7. The improvement according to claim 5, wherein said needle magazine includes stop means for engaging said retaining clip operable to pivot said retaining clip into a decoupling position to disengage said needle bar and said needle holder of a selected needle.

8. The improvement according to claim 3, wherein said second arm means includes a catch member shaped to engage said locking means, and wherein said locking means includes a holding jack pivotally mounted to said needle magazine, means for biasing said holding jack into engagement with said catch.

9. The improvement according to claim 4, wherein said second arm means includes a catch member shaped to engage said locking means, and wherein said locking means includes a holding jack pivotally mounted to said needle magazine, means for biasing said holding jack into engagement with said catch.

10. The improvement according to claim 3, wherein said needle bar includes a lower end face having a recess and said needle holder includes a stop member extending transversely to the axis of said elongated needle bar for stopping the axial movement of said needle bar relative to said needle holder of a selected needle in one direction.

11. The improvement according to claim 3, wherein said needle magazine includes a U-shaped cross-section having an open side facing said needles.

12. The improvement according to claim 11, further providing guide means for axially guiding said needle holders within said needle magazine, said guide means including a guide bar and said needle holders including a slot-type recess for fittingly receiving said guide box.

13. The improvement according to claim 1, wherein the means for selectively imparting axial reciprocatory movement includes means for driving said needle bar with an idle stroke corresponding to the working stroke of said needle bar.

* * * * *